United States Patent [19]

Hubbard et al.

[11] 4,360,990

[45] Nov. 30, 1982

[54] METHOD AND APPARATUS FOR DECORATIVE ETCHING OF SURFACES

[75] Inventors: James B. Hubbard, Westlake; Thomas E. Makus, Fairview Park, both of Ohio

[73] Assignee: Mak-Ard Industries, Incorporated, Westlake, Ohio

[21] Appl. No.: 209,875

[22] Filed: Nov. 24, 1980

[51] Int. Cl.[3] ..... E05D 13/02

[52] U.S. Cl. ..... 51/410; 51/426

[58] Field of Search ..... 51/310, 319, 410, 412, 51/426, 436, 439

[56] References Cited

U.S. PATENT DOCUMENTS

| | | | |
|---|---|---|---|
| 2,277,911 | 3/1942 | Johnson | 51/412 |
| 2,467,004 | 4/1949 | Battey | 51/412 |
| 2,608,800 | 9/1952 | Ritter | 51/410 X |
| 2,953,875 | 9/1960 | Mead | 51/410 |
| 3,599,375 | 8/1971 | Nunemaker | 51/439 X |
| 3,624,966 | 12/1971 | Palmer | 51/310 X |
| 4,232,487 | 11/1980 | Brown | 51/436 X |

*Primary Examiner*—James G. Smith

*Attorney, Agent, or Firm*—Pearne, Gordon, Sessions, McCoy & Granger

[57] ABSTRACT

Method and apparatus for decorating by selective etching of a sheet of glass or other etchable workpiece with a stream of high velocity abrasive particles that strike against a surface portion to be etched. The workpiece is supported on a stand over an opening through which abrasive particles are propelled against the workpiece. A hopper located below the opening and spaced therefrom contains a quantity of the abrasive particles and a gaseous stream is directed upwardly from the bottom of the hopper toward the opening to carry abrasive particles at relatively high velocity toward the opening. A filter is interposed in a space between the top of the hopper and the top of the stand, and is adapted to permit the passage of gas while filtering out abrasive particles entrained in the gas. In order to assure that the opening is covered either by a glass sheet or other means when the apparatus is in operation, a safety means is provided so that the gaseous stream is directed through the hopper only when the opening is covered.

12 Claims, 8 Drawing Figures

APPARATUS A

Fig. 2
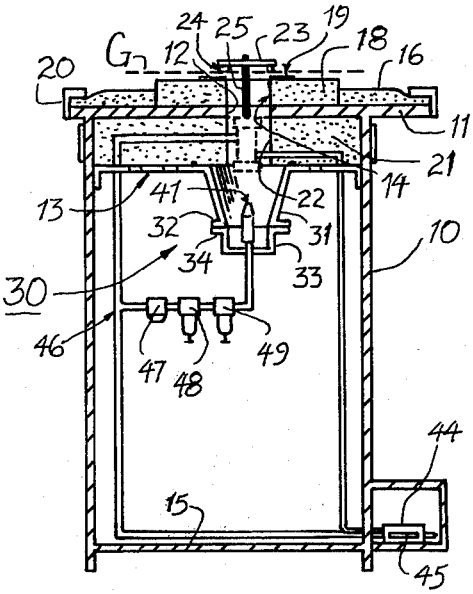
Fig. 4
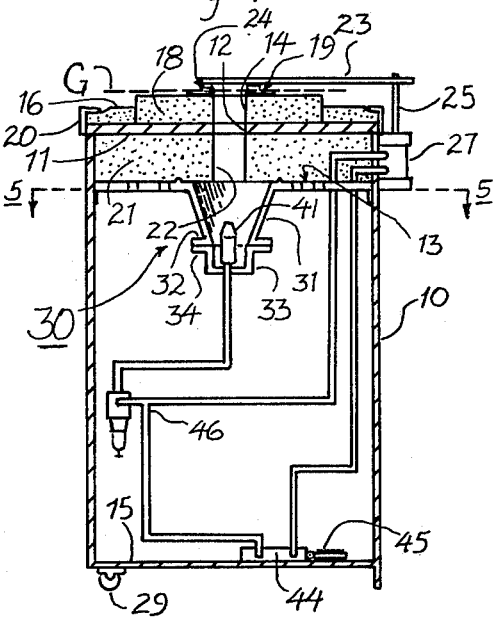
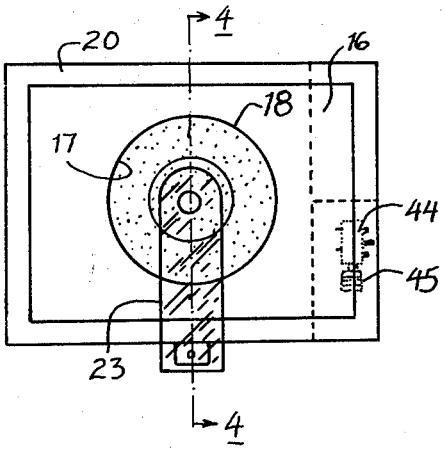
Fig. 3
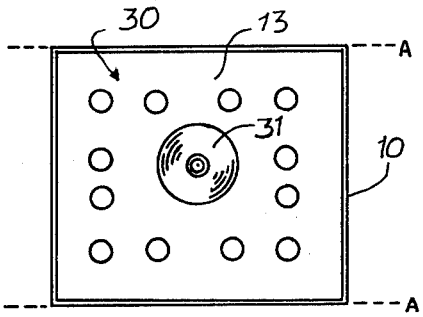
Fig. 5

METHOD AND APPARATUS FOR DECORATIVE ETCHING OF SURFACES

BACKGROUND OF THE INVENTION

This invention relates to the decorative marking of surfaces, such as the surfaces of sheets of glass and other hard but abradable material. More particularly, the invention is concerned with the etching of such surfaces with abrasive particles, such as particles of aluminum oxide, silicone carbide, and silica sand (such etching often being referred to as "sandblasting"), especially with respect to decorating glass for picture frames, mirrors, and other decorative glass products.

While the invention is not limited to the decorative marking of glass, and in fact has broad application to the marking of surfaces generally, the present discussion will be limited to the etching of glass sheets used in the picture framing art. Also, the abrasive surface treatment commonly known as "sandblasting" will be referred to as "etching" herein.

It is known in the art, such as from U.S. Pat. No. 2,608,800, that decorative etching of glass may be accomplished by masking the surface of the glass except for the portion to be marked. This can be done with a stencil or a sheet of plastic contact film that is subsequently cut to expose the surface portion to be etched. Then, the exposed portion is treated with abrasive particles propelled such as in a high velocity stream of air against the glass. This technique of decorative etching is seldom employed in the picture framing trade, however, due to the necessity of using expensive and specialized sandblasting equipment and procedures. Unless the glass sheets are relatively small and can be etched in sandblasting cabinets, the operation must be performed in rooms specially equipped for this purpose. As such, it is an extremely dusty and hazardous operation, requiring special safety suits and protective masks. Accordingly, custom picture framing shops are not known to be equipped to perform sandblasting operations or decorative etching of the type described. The method and apparatus of the present invention, however, reduce the difficulties indicated above and afford other features and advantages heretofore not obtainable.

SUMMARY OF THE INVENTION

It is among the objects of the invention to provide a convenient, safe, and relatively compact apparatus for decorating a sheet of glass or other abradable workpiece by selective etching.

Another object is to improve the safety of operation of equipment for etching the surface of a glass workpiece with a stream of high velocity abrasive particles.

A further object is to provide improved means for filtering out particles entrained in air that is exhausted during a decorative etching operation of the type described.

These and other objects and advantages are achieved with the unique method and apparatus of the present invention which are adapted to etch a workpiece, such as a sheet of glass or the like, with a high velocity stream of abrasive particles that are aimed so as to strike the surface portion of the workpiece to be etched.

The apparatus comprises a stand with a generally horizontal workpiece support at the top thereof and which has a central opening therein. Located below the opening is a hopper which is spaced from the workpiece support and is adapted to contain a quantity of the abrasive particles. Located at the bottom of the hopper is a nozzle associated with a fluid pressure supply means for directing a gaseous stream at relatively high velocity upward through the hopper toward the opening, whereby abrasive particles in the hopper become entrained in the stream and are carried thereby toward the opening. A filter with a central opening is interposed between the top of the hopper and the workpiece support so that gases may pass therethrough, whereby particles entrained in escaping atmosphere will be filtered out.

As a safety feature, means are provided for placing a movable safety shield over the opening such that the gaseous stream is directed through the hopper only when the hopper is covered by the safety shield. According to the preferred embodiment, the safety shield is also used to clamp the workpiece in position over the opening.

BRIEF DESCRIPTION OF THE DRAWINGS

FIG. 2 is a sectional view of the apparatus of FIG. 1;

FIG. 3 is a plan view of the apparatus of FIG. 1;

FIG. 4 is a sectional view, taken on the line 4—4 of FIG. 3;

FIG. 5 is a sectional view, taken on the line 5—5 of FIG. 4;

DESCRIPTION OF THE PREFERRED EMBODIMENT

Figure 1:
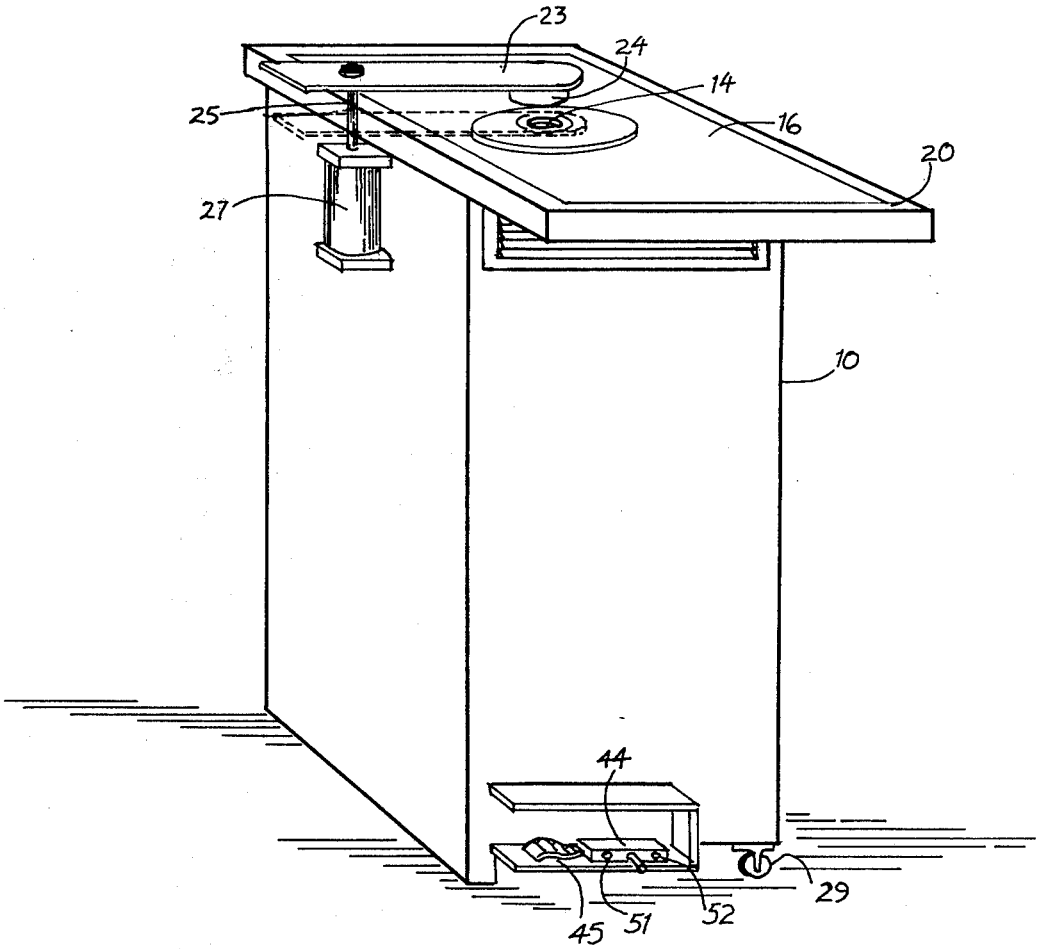
FIG. 1 is a perspective view of an etching apparatus embodying the invention.
Figure 6:
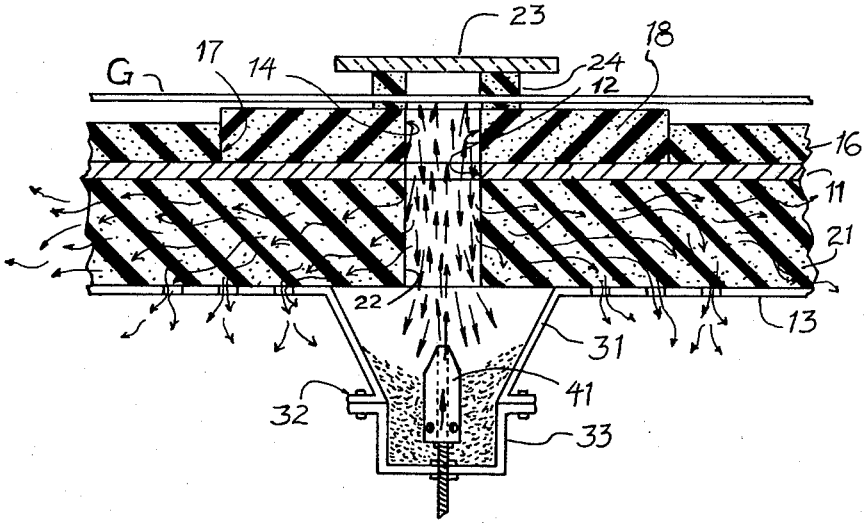
FIG. 6 is a fragmentary, sectional view on an enlarged scale, taken on the same line as FIG. 2.
Figure 7:
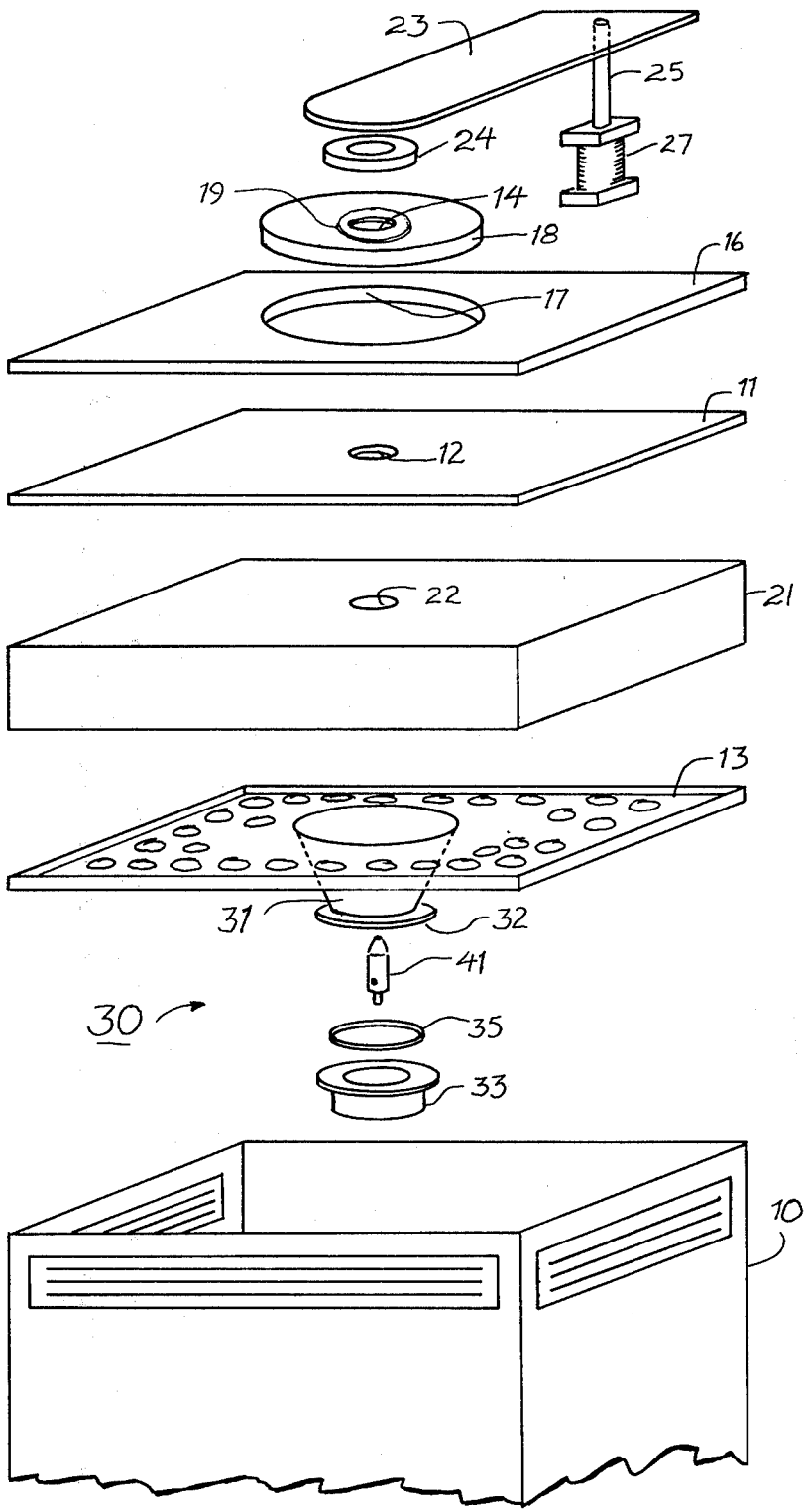
FIG. 7 is a fragmentary, exploded, perspective view on a large scale, illustrating the relationship between the principal components of the apparatus of the invention.

Referring more particularly to the drawings, and initially to FIGS. 1 through 6, there is shown an etching apparatus A embodying the invention for performing a decorative etching operation on a glass sheet G, such as for use in picture framing. The glass sheet G is normally covered with a stencil or with a sheet of plastic contact film in which the pattern to be etched is cut so as to expose the surface portion of the glass sheet to be etched.

The apparatus A generally includes a stand 10, preferably in the form of an enclosed cabinet, a hopper assembly 30 located within the stand which contains a quantity of abrasive particles used to perform the etching of the glass, and an air pressure system 40 used to produce a stream of high velocity abrasive particles that strike the surface of the glass and also used to operate an air cylinder for a safety shield to be described below.

The stand 10 comprises a horizontal workpiece support plate 11 located at the top and which has a centrally located opening 12. Spaced below the workpiece support plate 11 is the hopper assembly 30 which has an upper tray 13 of rectangular shape and about the same size as the support plate 11. A floor plate 15 is located at the bottom of the stand and supports various components of the air pressure system 40.

A pad 16 formed of a relatively soft, resilient material, such as polyfoam, about one inch thick, is located on top of the workpiece support plate 11 and has a central opening 17 concentric with opening 12. A resilient annular insert 18 is located within the opening 17, and is slightly thicker than the pad 16. The insert has a central opening 14 with the same diameter as and concentric with the openings 12 and 17. A seal ring 19 formed of polyethylene foam is adhered to the top of the insert and serves to cooperate with the glass sheet G placed on top of the stand to seal the glass against escape of abrasive particles from the stream of abrasive particles that is directed against the bottom surface of the glass sheet.

The top pad 16 is secured to the workpiece support plate 11 with an angle-shaped edge retainer strip 20 that clamps down the edges of the pad against the plate 11.

A filter block 21 is located between the workpiece support plate 11 and the tray 13, the block 21 having a central opening 22 concentric with the central openings 12 and 14. The filter block 21 permits escape of air from the hopper zone, and at the same time filters out any abrasive particles that might otherwise escape into the atmosphere in the work area. Clean air passing through the filter block 21 escapes through vents in the sides of the stand 10 and through holes formed in the bottom of the tray 13. The filter block 21 is formed of an air-permeable material, perferably an open-celled foam material, such as that normally referred to as "POLY-FOAM." A polyether urethane foam manufactured by American Foam Products, Inc. and sold under Product No. 2011 30-36ILD (1.15 lbs. per cu. ft.) has been found to be particularly suitable for this purpose. Although abrasive particles permeate somewhat into the open-celled foam material, it has been found that essentially no particles escape and that, although foam is used during operation of the device for long periods of time, the particles do not effectively block or inhibit the passage of air therethrough.

It will be noted that the openings 12, 14, 17, and 22 are all concentric about a central, vertical axis or centerline, and that they define a passage extending from the hopper assembly 30 through the top of the stand 10. Accordingly, when the glass sheet G with proper masking is placed on the workpiece support plate 11, with the portion to be etched over the opening 14 in the insert 18, a high velocity stream of abrasive particles may be safely directed upwardly along the central axis to strike against the exposed surface of the glass sheet G. The nature of this operation presents certain inherent dangers, such as in the event the equipment would be operated without the glass sheet G covering the opening in the insert 18.

In accordance with the invention, a special safety mechanism is provided to assure that the danger of the high velocity stream of abrasive particles being directed upwardly above the stand 10 is essentially eliminated. The safety mechanism includes a safety shield/clamp 23 that is mounted on a piston rod 25 for movement between a raised, neutral position shown in solid lines in FIG. 1 and a lowered clamping position shown in dashed lines in FIG. 1 wherein the shield is located over the opening 12 so that the high velocity stream of abrasive particles will be blocked. The movement of the safety shield/clamp between its raised and lowered positions is guided by a pair of vertical guide rods mounted on the stand and which extend through openings in the shield. Because the safety shield/clamp 23 normally bears against the top surface of the glass sheet G when in its lowered position, a low-friction foam pad 24 is secured to its bottom surface to provide a cushioned engagement with the glass.

The safety shield/clamp 23 is preferably formed of a transparent material, such as a clear plastic, a hard, durable plastic such as Plexiglas being preferred. The lower end of the rod 25 is connected to the piston 26 of an air cylinder 27 mounted on the front of the stand 10 and operated by the air pressure system 40, best shown in FIG. 8, and which will be described in detail further below.

The hopper assembly 30 comprises, in addition to the tray 13, an upper hopper section 31 molded integrally with the tray 13 with an annular flange 32, and a lower hopper section 33 with an annular flange 34 that mates with the annular flange 32 and is secured thereto to hold the sections 31 and 33 in assembled relation. A seal ring 35 is placed between the sections to prevent escape of abrasive particles.

The hopper assembly 30 is filled with a quantity of abrasive particles, such as aluminum oxide or silicon carbide. It has been found that aluminum oxide is particularly suitable for etching surfaces of glass. The particles preferably have a size of about 80–100 mesh, although the particle size is not believed to be critical.

Figure 8:
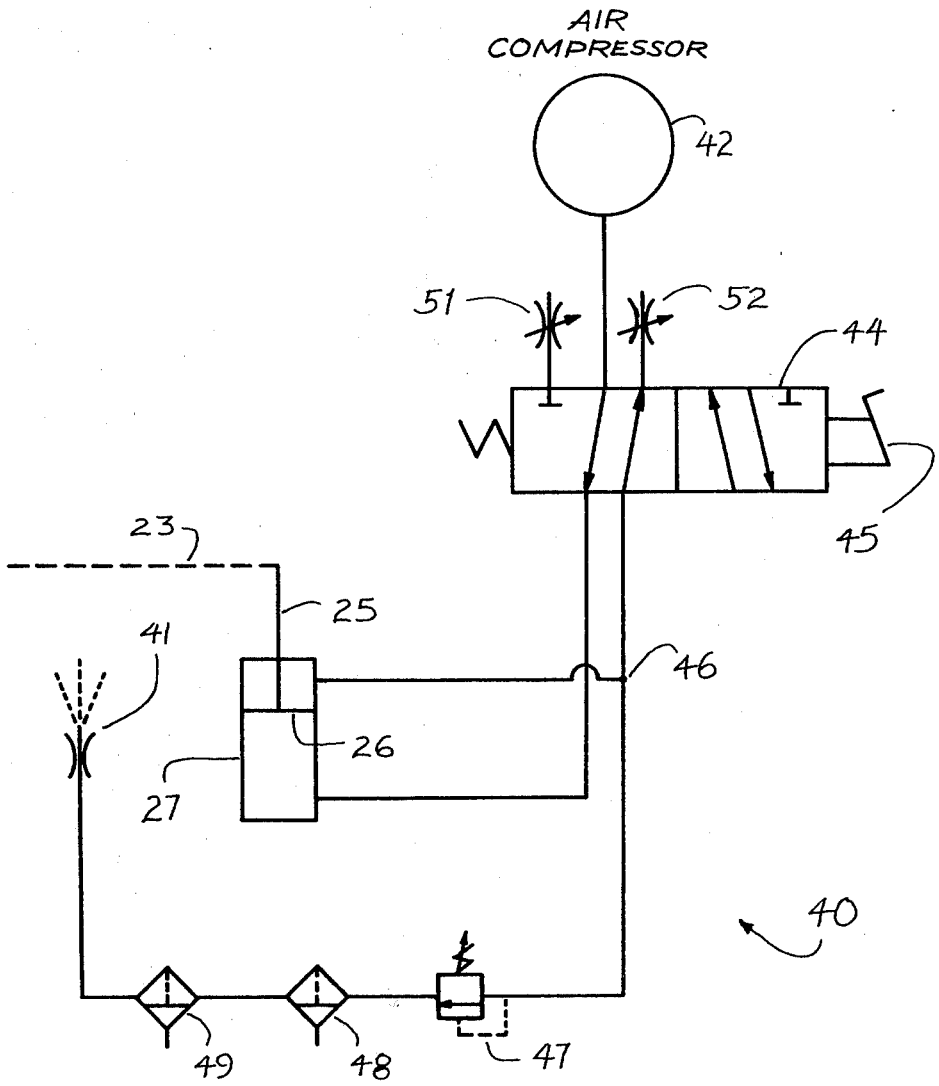
FIG. 8 is a schematic diagram of the fluid pressure system embodied in the apparatus of the invention.

In order to drive the abrasive particles in the hopper assembly upwardly in a high velocity stream against the surface of the glass sheet G to be etched, a high velocity stream of air is driven through a nozzle 41 mounted at the bottom of the lower hopper section 33, by means of the air pressure system 40, best shown in FIG. 8. The air pressure system includes a compressor 42, such as the piston-type air compressor manufactured by Thomas Industries, Inc. of Sheboygan, Wis. and sold under the trade designation WOB.L piston compressor, Model No. 1007CM72.

The compressor 42, which is supported on the floor plate 15, supplies air under pressure for operating the air cylinder 27 attached to the front of the stand 10 and which raises and lowers the safety shield 23, as well as for the high velocity stream of air that is directed upwardly from the nozzle 41. The supply of air is controlled by a foot-operated four-way valve 44 located at the side of the stand 10 on the floor plate 15, as shown in FIG. 1. A suitable four-way valve is commercially available under the trade designation "NUGGET" T 71DA00-TSI-TFO and is manufactured and sold by C. A. Norgren Co. of Littleton, Colo. The valve 44 is shown in its normally closed position in FIG. 8 and is operated by a foot pedal 45.

When the valve 44 is moved to its open position by the foot pedal 45, air under pressure is directed to a "T" fitting 46 from which one branch connects to the upper end of the air cylinder 27 to force the piston 26 down and bring the safety shield 23 to its lowered position. The other branch from the "T" fitting 46 proceeds to the nozzle 41 through a relief valve 47 that is adjusted to a setting that keeps the valve 47 closed until the piston 26 of the air cylinder 27 is fully retracted and the air pressure is consequently increased in the line. An oil filter 49 and moisture/particle filter 48 are connected in series downstream of the relief valve 47 to filter out any oil and/or moisture and/or foreign particles that would otherwise cause lumps to develop in the supply of abrasive particles.

A pair of flow restrictors or mufflers 51 and 52 are attached to the exhaust ports of the four-way valve 44 to control the speed of operation of the air cylinder 27 and to reduce noise.

OPERATION

Prior to the operation of the apparatus A, the glass sheet G to be etched is prepared by applying masking material as previously described to the glass surface on which the etching is to be accomplished. The masking material is preferably a plastic film, with contact adhesive applied to one side. Where irregular glass surfaces are to be etched, masking tape is preferred. Linear portions of the masking material are removed with a suitable cutting tool such as a hobby knife, razor blade, carving knife, or the like. Once the desired pattern has been cut into the masking material, and the cut material removed, the surface portions of the glass sheet G to be etched are exposed.

The masked glass sheet G is then placed on the workpiece support plate 11, with the surface to be etched facing down and resting on the foam pad 16 and with a portion of the surface placed over the opening in the insert 18. The masked surface engages the seal ring 19 to provide a seal, and thus prevent the escape of abrasive particles from the etching apparatus A. The top pad 16 and insert 18 protect the surface of the glass against abrasion as the glass is moved from one position to another over the opening 14. Once the glass is in its initial position, the foot pedal 45 is depressed to open the valve 44 and actuate the air cylinder 27 to move the safety shield/clamp 23 downward to securely engage the top of the glass sheet G. Once the air cylinder piston 26 is fully retracted, the resulting pressure increases, opening the relief valve 47 and causing air to be supplied to the nozzle 41. It is assumed, of course, that the compressor 42 has been switched on and is operating before the etching operation begins.

The stream of air under pressure surging through the air line passes through a venturi throat forming part of the nozzle 41, creating a suction to draw the abrasive particles through orifices that are buried in the supply of abrasive particles. The particles are then propelled upwardly by the high velocity stream of air to mechanically erode the exposed surface of the glass held against the seal ring 19. Then, the abrasive particles are continuously recirculated with almost no loss because air is exhausted from the stand through the open-celled "POLYFOAM" filter block 21 and thence through ports in the sides of the stand and through holes in the bottom of the tray 13. It will be noted that ports are provided in the sides of the stand 10 so that there is no obstruction to the escape of air to the work area.

As indicated above, some abrasive particles that are entrained in the air are collected in the filter block 21 so that the air that passes out of the filter block is clean and free of dust and particles. The abrasive particles, for the most part, fall back into the hopper 30 and are reused in a continuous cycle.

It will be noted that while the safety feature utilized in the abrasive etching apparatus A shown and described herein utilizes a safety shield 23 to prevent any risk of abrasive particles being propelled out of the stand and into the work area, other safety devices may also be used, such as a safety switch that responds to the positioning of the glass sheet on the workpiece support plate 11. A switch, for example, could be located in the top pad 16 in such a way that it is actuated only when the sheet is placed on the pad 16 to depress the switch, and thus open a safety valve located in the air line.

The designs and sizes of etching patterns that can be used to form decorative marking on the glass sheet G are essentially unlimited and add a new and useful dimension to the art. As to dark-hued mats or other underlayments, such as black, dark brown, dark blue, etc., the effects of etching show up without further treatment. Light-hued mats or other underlayments can be used with etched glass by rubbing graphite into etched areas or by painting etched areas to contrast with the hue of the underlayment. Novel effects are obtained by cutting out letters, designs, and pictures on the masking material. Multiple layers of etched glass sandwiched or separated by spacers also provide dimensions as yet unknown to the picture framing art.

While the invention has been shown and described with respect to a specific embodiment of the method and apparatus thereof, this is intended for purposes of illustration rather than limitation and other variations and modifications of the specific method and apparatus herein shown and described will be apparent to those skilled in the art, all within the intended spirit and scope of the invention. Accordingly, the patent is not to be limited in scope and effect to the specific embodiments herein shown and described, nor in any other way that is inconsistent with the extent to which the progress in the art has been advanced by the invention.

What is claimed is:

1. Apparatus for etching a workpiece such as a sheet of glass or the like with abrasive particles that are propelled against a surface portion of the workpiece, comprising:

a stand with a generally horizontal workpiece support at the top thereof;

means defining an opening in said support over which a portion of said workpiece may be placed;

a hopper located below said opening, spaced from said support and adapted to contain a quantity of said abrasive particles;

fluid pressure means including a nozzle mounted in said hopper for directing a gaseous stream at relatively high velocity upwardly through said hopper toward said opening whereby abrasive particles in said hopper become entrained in said stream and are carried thereby toward said opening to strike said surface portion of said workpiece;

filter means interposed between the top of said hopper and said workpiece support and defining an open space between said opening and said hopper whereby gases may pass therethrough outwardly from said space and said abrasive particles entrained in said gases will be filtered out;

movable shield means adapted to be selectively positioned over said opening and being movable between a retracted position and a protective operating position closely spaced above said opening; and means responsive to said shield means whereby said gaseous stream is directed through said hopper only when said opening is in its protective operating position.

2. Apparatus as defined in claim 1, wherein said filter means comprises an open-celled polymeric foam material.

3. Apparatus as defined in claim 2, wherein said open-celled plastic foam material is a polyether urethane foam.

4. Apparatus as defined in either of claims 2 or 3, wherein said filter means comprises a block of said open-celled polymeric foam with a central opening aligned with said opening in said workpiece support.

5. Apparatus as defined in claim 1, wherein said workpiece support includes a layer of resilient polymeric material positioned on top thereof and adapted to provide a cushioned support for a workpiece positioned thereon.

6. Apparatus as defined in claim 5, wherein said layer of resilient polymeric material comprises an open-celled foam.

7. Apparatus as defined in claim 1, wherein said movable shield means comprises a relatively flat horizontally oriented safety shield member located above said workpiece support and movable between a raised position spaced above a workpiece located on said support and a lowered position overlying said opening and adapted to engage the top surface of a workpiece located on said support and to clamp said workpiece in place preparatory to actuation of said fluid pressure supply means.

8. Apparatus as defined in claim 7, wherein said safety shield is moved between its raised position and its lowered position by fluid means operatively associated with said fluid pressure means.

9. Apparatus as defined in claim 8, wherein said fluid pressure means comprises an air cylinder with a piston operatively connected to said safety shield member.

10. Apparatus as defined in claim 9, wherein said means responsive to said shield means comprises pressure relief means adapted to prevent flow of air to said nozzle while air pressure from said fluid pressure supply means is operating said air cylinder to move said safety shield to its lowered position, and to permit flow of air to said nozzle after said air cylinder is completely actuated to result in a higher pressure in said pressure supply means.

11. Apparatus for etching a workpiece such as a sheet of glass or the like with abrasive particles that are caused to strike a surface portion of the workpiece, comprising:

a stand with a generally horizontal workpiece support at the top thereof;

means defining an opening in said support;

a hopper located below said opening spaced from said support and adapted to contain a quantity of said abrasive particles;

fluid pressure means including a nozzle mounted at the bottom of said hopper for directing a gaseous stream at relatively high velocity upwardly through said hopper toward said opening whereby abrasive particles in said hopper become entrained in said stream and are carried thereby toward said opening to strike said surface portion of said workpiece; and a block of open-celled polymeric foam material interposed between the top of said hopper and said workpiece support and having an opening therethrough aligned with said hopper and said opening in said workpiece support whereby gases may pass through said block outwardly from said opening and said abrasive particles entrained in said gases will be filtered out.

12. Apparatus as defined in claim 11, wherein said foam material is a polyether urethane foam.

* * * * *